US005390576A

United States Patent [19]

Ishibashi

[11] Patent Number: 5,390,576

[45] Date of Patent: Feb. 21, 1995

[54] CUTTING MACHINE

[75] Inventor: Teruhiko Ishibashi, Shizuoka, Japan

[73] Assignee: Fuji Photo Film Co., Ltd., Kanagawa, Japan

[21] Appl. No.: 232,406

[22] Filed: Apr. 25, 1994

Related U.S. Application Data

[63] Continuation of Ser. No. 39,775, Mar. 26, 1993, abandoned.

[30] Foreign Application Priority Data

Mar. 26, 1992 [JP] Japan ..... 4-068717

[51] Int. Cl.[6] ..... B26D 1/06

[52] U.S. Cl. ..... 83/613; 83/697

[58] Field of Search ..... 83/613, 651, 679, 694, 83/697, 701

[56] References Cited

U.S. PATENT DOCUMENTS

| | | | |
|---|---|---|---|
| 3,364,556 | 1/1968 | Cocce et al. | 83/697 X |
| 3,509,790 | 5/1970 | Hoppe | 83/697 |
| 3,532,021 | 7/1968 | Beckner | 83/679 |
| 4,427,740 | 6/1981 | Yamazaki | 83/592 |

FOREIGN PATENT DOCUMENTS

| | | | |
|---|---|---|---|
| 221326 | 8/1941 | France . | |
| 2437860 | 8/1974 | Germany . | |
| 0254350 | 2/1988 | Germany | 83/697 |
| 0157419 | 12/1980 | Japan | 83/697 |
| 2109699 | 4/1990 | Japan . | |

*Primary Examiner*—Eugenia Jones

*Attorney, Agent, or Firm*—Sughrue, Mion, Zinn, Macpeak & Seas

[57] ABSTRACT

A guillotine-type cutter blade cuts sheets such as papers, metallic plates, etc. The cutter blade is provided at the back face with a flank which is inclined at an angle of 1° to 7° with respect to the moving direction of the cutter so as not to be in contact with the cut surface of the sheets, thereby preventing formation of a built-up edge.

6 Claims, 4 Drawing Sheets

CUTTING MACHINE

This is a continuation of application Ser. No. 08/039,775, filed Mar. 26, 1993, now abandoned.

BACKGROUND OF THE INVENTION

1. Field of the Invention

The present invention relates to a guillotine-type cutting machine and more particularly to an improvement in a cutter blade for cutting a large number of stacked large size sheets or plates.

2. Description of the Related Art

Cutting machines are used to cut a stack, which includes a large number of thin sheets or plates such as paper sheets, plastic sheets, aluminum plates, etc., into a plurality of predetermined small size sheets. The cutting machines are of a guillotine type in which a single-edged cutter blade is moved vertically to cut the sheets. The cutter blade has a cutting face and a vertically flat face or a back face intersecting the cutting face to form a cutting edge. In cutting the sheets, the cutting face pushes cut sheets away from the stack while the flat face is made to face the cut surface of the stack.

Such a cutter blade tends to have cutting dust stuck thereto after only a few cutting operations, depending on the material of the sheets and the number of sheets in the stack. The dust causes scratches to be formed on the cut surface of the sheets. Conventionally, various countermeasures have been taken to prevent this problem. For example, in the case of cutting a stack of aluminum sheets, a paper laminated with a polyethylene is interposed as a interleaf between each of the aluminum sheets, or a lubricant is applied to the cutter blade as described in Japanese Patent Laid-Open Publication No. 2-109699.

However, when cutting a stack of metallic sheets with paper interposed, the cutting edge of the cutter blade is damaged after as few as 10 cuts, which causes the cut surface of the metallic sheets to be scratched linearly by cutting dust. Also, the dust adheres to the back face of the cutter blade because of heat generated in cutting to cause a built-up edge portion to be formed on the cutting edge.

It is known to form cutter blades with a flank in their back faces in order to prevent formation of a built-up edge portion. However, conventionally, the inclinations of the flanks with respect to the moving direction of the cutter blades are approximately only 0.02°. Accordingly, a built-up edge portion still is formed quickly. Therefore, it is necessary to change the cutter as often as every 10 cuts, resulting in degradation of efficiency of the cutting operation.

SUMMARY OF THE INVENTION

It is therefore an object of the present invention to provide a cutter blade whose lifetime is long.

It is another object of the present invention to provide a cutter blade by which cutting operations can be performed efficiently.

In order to achieve the above and other objects of the present invention, a cutter blade of the present invention is provided, at a back face thereof, with a flank having an inclination of 1° to 7° with respect to the moving direction of the cutter blade such that the flank will not come into contact with the cut surface of the stack sheets. The flank may be formed with a flat surface or a curved surface. Also, the flank may be formed by inclining a cutter blade with a spacer attached to the back surface of cutter blade.

According to the present invention, the lifetime of the cutter blade can be lengthened, contributing to improvement in efficiency of cutting operations.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
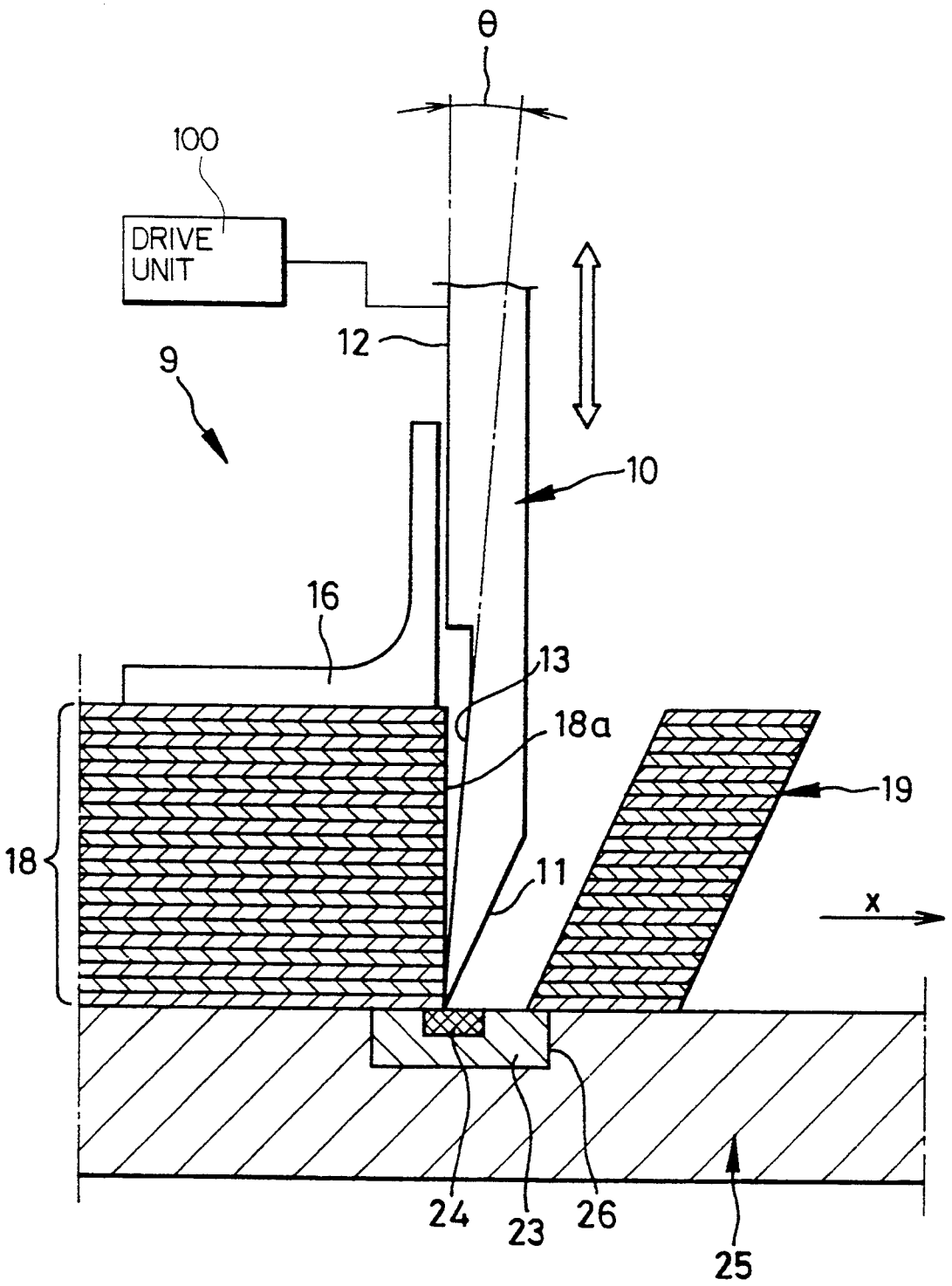
FIG. 1 is a cross section illustrating a cutting condition with a cutter blade according to a preferred embodiment of the present invention.

In FIG. 1, illustrating a cutting machine 9, a cutter blade 10 has a cutting face 11 and a vertically flat face or a back face 12. The back face 12 is provided with a flank 13. The width of the cutter blade 10 is 1.8 m. The cutter blade 10 is attached to the base plate of a drive unit 100 (not illustrated schematically) by screws and driven in a direction indicated by an arrow which is perpendicular to a cutting stage 25. A clamp 16 presses and fixes stacked sheets 18 on the cutting stage 25.

Figure 2:
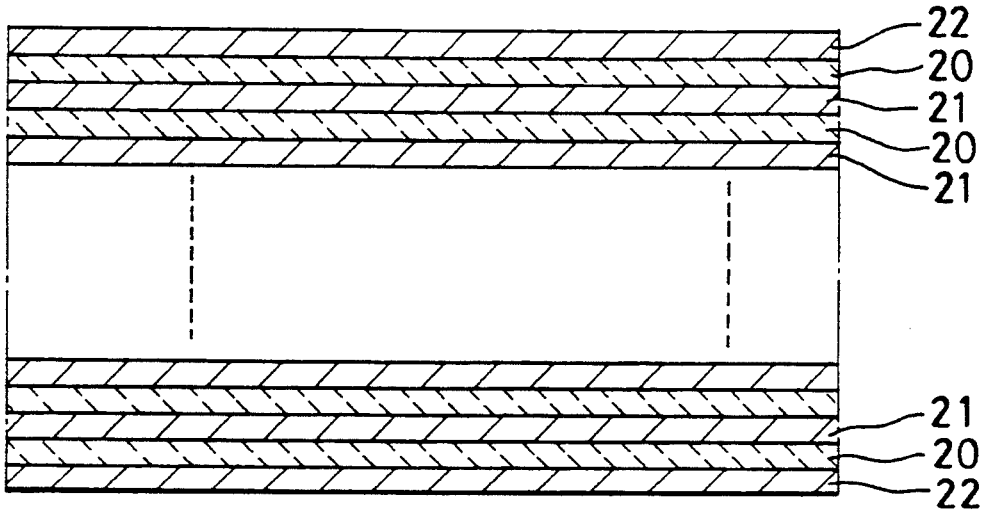
FIG. 2 is a cross section illustrating a stack of aluminum sheets, which are piled alternately with interleaves and sandwiched by cardboard sheets.

As illustrated in FIG. 2, in cutting a stack of aluminum sheets, a number of aluminum sheets 20 and a number of interleaves 21 are first piled alternately, all of which are sandwiched by cardboard sheets 22 from upper and lower sides to form a set. Several sets thereof are piled one over another to constitute the stacked sheets 18 disposed on the cutting stage 25. In this embodiment, the cutting machine 9 cuts presensitized plates having aluminum supports. However, the invention also applies to cutting stacks of paper, plastic sheets, etc.

Referring to FIG. 1, a cut surface 18*a* of the stacked sheets 18 is formed by means of the cutter blade 10, and is parallel to a moving direction of the cutter blade 10. A wood pad 24 held by a pad holder 23 is fitted in a recess 26 of the cutting stage 25. When the cutter blade 10 is let down, the cutting edge of the cutter blade 10 cuts into the wood pad 24 so as to cut the stacked sheets 18 completely.

Figure 3:
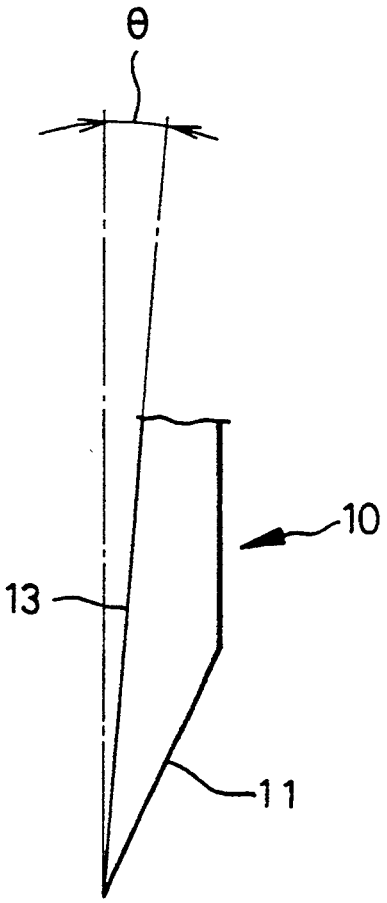
FIG. 3 illustrates a portion of the cutter blade of FIG. 1.

As illustrated in FIG. 3, the flank 13 is inclined at an angle $\theta$ with respect to the moving direction of the cutter blade 10 so as not to be in contact with the cut surface 18*a*. The angle $\theta$ is preferably set to be in a range of 1° to 7°. If the angle $\theta$ is less than 1°, a built-up edge portion will quickly form to cause scratches of the cut surface 18*a*. If the angle $\theta$ is more than 7°, the cutter blade may not be strong enough and thus may be broken.

The operation of the above embodiment will be described below. After the stacked sheets 18 are fixed by the clamp 16, the cutter blade 10 is let down from an initial position by the drive unit 100. Then, the cutting edge of the cutter blade 10 cuts into the stacked sheets 18. The cut portions 19 of the stacked sheets 18 are pushed by the cutting face 11 in a direction X as indicated in FIG. 1. Thereafter, the cutter blade 10 is raised to retreat to the initial position. After the clamp is released, the stacked sheets 18 are moved by a predetermined length in the direction X and pressed and fixed again by the clamp 16. As soon as the cut portion 19 of the stacked sheets 18 are removed from the cutting stage 25, the cutter blade 10 in the initial position is let down again. This operation is repeated to cut the stacked sheets 18 sequentially.

The number of times which the cutter blade 10 can reliably perform sequential cuttings varies in accordance with the kind of stacked sheet material, the number of piled sheets in a stack, and the angle $\theta$ of the flank provided in the cutter blade.

Therefore, the angle $\theta$ of the flank 13 of the cutter blade 10 was varied to test how many times the cutter blade 10 can cut the stacked sheets 18. 50 aluminum sheets of 0.3 mm thickness and 50 interleaves were alternately piled, all of which were sandwiched by the two cardboard sheets 22 to form one set. Three sets thereof were piled one over another to constitute the stacked sheets 18. The stacked sheets 18 were cut at 550 mm. The cutter blade 10 was formed of high-strength steel. The results of the test are in the following Table 1.

TABLE 1

| Angle ($\theta$) | 0.02° | 0.5° | 1.0° | 3.0° | 5.0° | 7.0° | 9.0° or more |
|---|---|---|---|---|---|---|---|
| Maximum times of successive Cuts | 10 | 50 | 250 | 500 | 700 | 1000 | not able to cut |
| Cutter Strength | | | | up←→down | | | |

As is apparent in Table 1, when the angle $\theta$ of the flank 13 was in a range from 1° to 7°, 250 to 1,000 sequential cuttings were possible before a built-up edge portion was formed on the cutter blade 10. However, when the angle $\theta$ of the flank 13 was 9° or more, the strength of the cutter blade 10 was too small to use it for cutting. In view of the test results above, it is apparent that the range of 1°–7° for a flank angle is a critical range which yields superior results over known devices.

Figure 4:
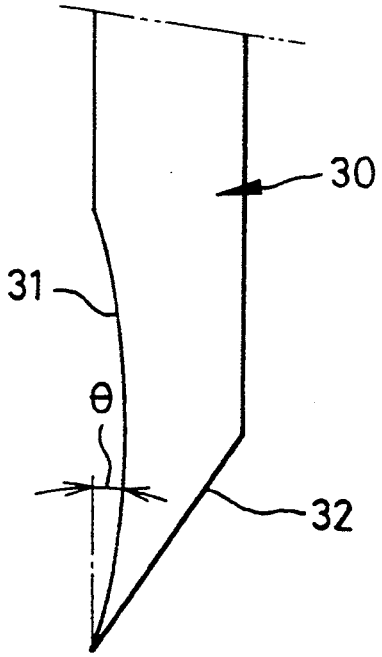
FIGS. 4 to 6 illustrate cutter blades according to additional embodiments of the present invention.
Figure 5:
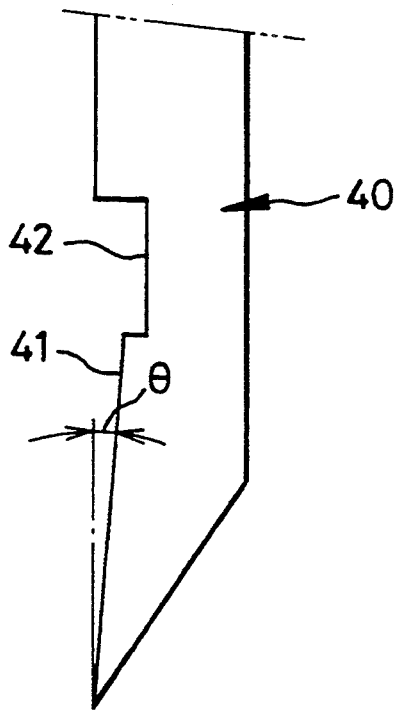
Figure 6:
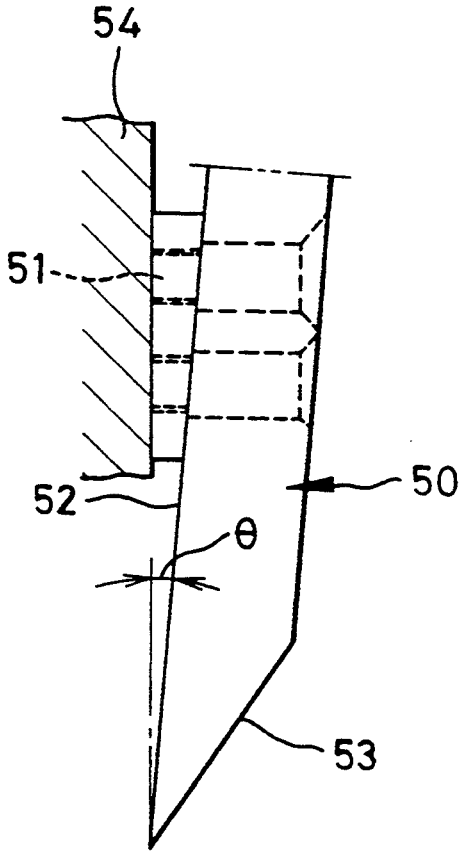

In FIG. 4 illustrating a second embodiment, a cutter blade 30 has a curved flank 31. In FIG. 5, illustrating a third embodiment, a cutter blade 40 has a flank 41 with a recessed portion 42. Further, in FIG. 6, illustrating a fourth embodiment, when attaching a cutter blade 50 with a flat back face 52 to a base plate 54 of the drive unit, a spacer 51 may be inserted to incline the cutter blade 50. Thereby, the inclined back face 52 serves as a flank.

While the present invention had been described in detail above with reference to preferred embodiments shown in the drawings, it will be apparent to those skilled in the art that various changes and modifications of the present invention are possible without departing from the scope of the invention as defined by the following claims.

What is claimed is:

1. A cutting device including a cutter blade having a front face with a cutting face formed thereon and a back face intersecting said cutting face to form a cutting edge for cutting a number of piled sheets, said back face facing a cut surface of said piled sheets at the time of cutting, said cutting device comprising:

means for moving said cutter blade in a vertical plane, which is perpendicular to a surface of a first one of said piled sheets, to successively cut through said piled sheets; and a flank surface defined on said back face and extending towards said front face at an angle of 1° to 7° with respect to the plane defined by said back face so as not to contact said cut surface;

said cutting face extending at an angle between a tip of the blade and said front face.

2. A cutter blade as recited in claim 1, wherein a lower portion of said back face is cut off in a linear manner to form said flank surface, said flank having a flat surface.

3. A cutter blade as recited in claim 2, wherein said flank surface has a recessed portion formed therein.

4. A cutter blade as recited in claim 1, wherein a lower portion of said back face is cut off in a curved manner to form said flank surface, said flank surface being curved.

5. A cutter blade as recited in claim 1, wherein said flank surface is formed by inclining said cutter blade.

6. A cutter blade as recited in claim 5, wherein said cutter blade is attached to a base plate via a wedge-shaped spacer which is interposed between said cutter blade and said base plate.

* * * * *